US007469843B2

(12) United States Patent
Ricco et al.

(10) Patent No.: US 7,469,843 B2
(45) Date of Patent: Dec. 30, 2008

(54) SERVO VALVE FOR CONTROLLING AN INTERNAL COMBUSTION ENGINE FUEL INJECTOR

(75) Inventors: Mario Ricco, Valenzano (IT); Sisto Luigi De Matthaeis, Valenzano (IT); Adriano Gorgoglione, Valenzano (IT); Antonio Gravina, Valenzano (IT)

(73) Assignee: C.R.F. Societa Consortile per Azioni (IT)

( * ) Notice: Subject to any disclaimer, the term of this patent is extended or adjusted under 35 U.S.C. 154(b) by 377 days.

(21) Appl. No.: 11/112,812

(22) Filed: Apr. 21, 2005

(65) Prior Publication Data

US 2006/0000930 A1 Jan. 5, 2006

(30) Foreign Application Priority Data

Jun. 30, 2004 (EP) ..... 04425474

(51) Int. Cl.
*B05B 1/08* (2006.01)

(52) U.S. Cl. ..... 239/102.2; 239/96; 239/127; 239/584; 239/600; 251/57; 251/129.06; 123/498

(58) Field of Classification Search ..... 239/96, 239/124, 127, 102.1, 102.2, 584, 600; 251/48, 251/50, 57, 58, 129.06; 123/447, 498, 506
See application file for complete search history.

(56) References Cited

U.S. PATENT DOCUMENTS 5,979,790 A 11/1999 Gürich et al.
6,313,568 B1 * 11/2001 Sullivan et al. ..... 310/346
6,457,699 B1 * 10/2002 Stoecklein ..... 251/129.06
6,805,302 B2 * 10/2004 Boecking ..... 239/102.2
6,840,466 B2 * 1/2005 Igashira et al. ..... 239/102.2
2004/0069863 A1 4/2004 Mattes

FOREIGN PATENT DOCUMENTS

| | | |
|---|---|---|
| DE | 199 39 452 A | 3/2001 |
| DE | 103 09 885 A | 10/2003 |
| JP | 09144621 | 6/1997 |
| JP | 2001082281 | 3/2001 |
| JP | 2002227747 | 2/2002 |

OTHER PUBLICATIONS

European Search Report EP 04 42 5474 Dated Nov. 2, 2004.

* cited by examiner

*Primary Examiner*—Steven J Ganey
(74) *Attorney, Agent, or Firm*—Ostrolenk, Faber, Gerb & Soffen, LLP

(57) ABSTRACT

A control servo valve (8) is housed inside the casing (2) of an internal combustion engine fuel injector (1), and has a piezoelectric actuator (40), and a control chamber (13) having a fuel outlet passage (21); the outlet passage (21) comes out inside an annular chamber (34) defined by a fixed tubular portion (25) and by a shutter (32), which engages the tubular portion (25) in substantially fluidtight manner and is slid axially by the piezoelectric actuator (40) from a closed position, in which it closes the annular chamber (34) and is subjected to a zero axial resultant force by the fuel pressure, to an open position, in which the outlet passage (21) communicates with a discharge conduit.

12 Claims, 1 Drawing Sheet

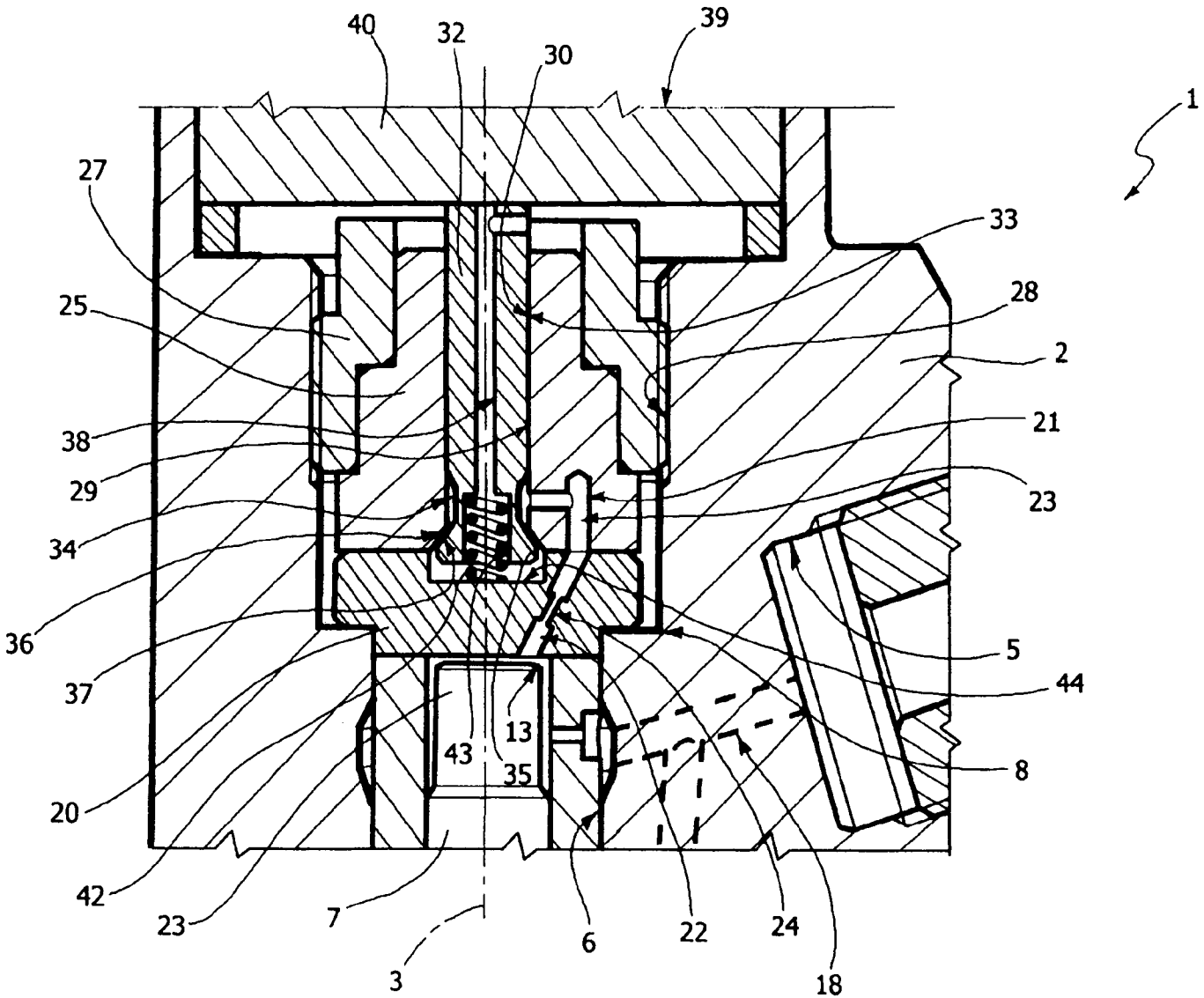
1
33
28
2
21
23
5
44
8
18
24
22
6
39
30
32
40
13
35
43
3
7
23
27
25
38
29
34
36
37
20
42

SERVO VALVE FOR CONTROLLING AN INTERNAL COMBUSTION ENGINE FUEL INJECTOR

The present invention relates to a servo valve for controlling an internal combustion engine fuel injector.

As is known, an injector comprises an injector body which defines a nozzle for injecting fuel into the engine, and houses a control rod movable along a respective axis to activate a pin closing the nozzle. The injector body also houses an electromagnetic control servo valve comprising a control chamber bounded axially on one side by the control rod, and on the other by an end wall having an outlet hole which, outside the control chamber, comes out axially inside a conical seat. The control servo valve also comprises a shutter which in turn comprises a ball engaging the conical seat, and is activated by an electromagnet to move axially to and from the seat to open and close the outlet hole and so vary the pressure inside the control chamber. More specifically, the shutter is subjected on one side to the axial thrust exerted on the ball by the pressure of the fuel in the outlet hole, and, on the other side, to the pull of the electromagnet and the axial thrust of a spring preloaded to keep the outlet hole closed when the electromagnet is not energized.

Current market demand is for the use of piezoelectric as opposed to electromagnetic actuators.

When subjected to voltage, however, piezoelectric actuators can exert thrust but not pull, and therefore cannot be used in the known solutions described above.

Moreover, piezoelectric actuators produce relatively little displacement, so that, to achieve the necessary fuel discharge flow sections, travel amplification systems must be provided, or the shutter-outlet hole sealing area increased. On the one hand, travel amplification systems are undesirable, mainly by being complex and bulky; and, on the other, an increase in the sealing area would increase the axial force exerted by the fuel pressure on the shutter in the closed position, so that the preload of the spring would have to be increased to keep the shutter closed, and greater force would be required of the piezoelectric actuator, thus resulting again in considerable bulk and complexity.

It is an object of the present invention to provide a servo valve for controlling an internal combustion engine fuel injector, designed to meet the above demand in a straightforward, low-cost manner, and which preferably provides for ample fuel discharge flow sections, even with relatively little lift of the shutter, is compact, and comprises a relatively small number of components.

According to the present invention, there is provided a servo valve for controlling an internal combustion engine fuel injector; the servo valve being housed in a casing of said injector, and being characterized by comprising:

actuating means comprising a piezoelectric actuator;

a control chamber communicating with a fuel inlet and having a fuel outlet passage;

a tubular portion fixed with respect to said casing, and defining an inner seat extending along a longitudinal axis; and a shutter engaging said inner seat in substantially fluidtight manner, and defining, together with said tubular portion, an annular chamber in which said outlet passage comes out; the shutter being slid axially by said piezoelectric actuator from a closed position, in which it closes said annular chamber and is subjected to a zero axial resultant force by the fuel pressure, to an open position opening said outlet passage, to close and open a nozzle of said injector.

For a clear understanding of the present invention, a preferred, non-limiting embodiment of a servo valve for controlling an internal combustion engine fuel injector will be described by way of example with reference to the accompanying drawing showing a cross section of the servo valve with parts removed for clarity.

BRIEF DESCRIPTION OF THE DRAWINGS

The FIGURE is a view of an embodiment of the present invention showing a servo valve for controlling an internal combustion engine fuel injector.

Number 1 in the accompanying drawing indicates as a whole a fuel injector (shown partly) of an internal combustion engine, in particular a diesel engine (not shown). Injector 1 comprises an outer structure or casing 2 which extends along a longitudinal axis 3, has a lateral inlet 5 for connection to a pump forming part of a fuel feed system (not shown), and terminates with a nozzle (not shown) communicating with inlet 5 and for injecting fuel into a relative cylinder of the engine.

Casing 2 defines an axial seat 6, and houses a rod 7 which slides axially inside seat 6 to control a shutter pin (not shown) for closing and opening the fuel injection nozzle.

Casing 2 houses a control servo valve 8 comprising a control chamber 13 which is formed coaxially with rod 7, communicates permanently with inlet 5 along a passage 18 to receive pressurized fuel, and is bounded axially on one side by rod 7, and on the other by an end disk 20 housed in a fixed position inside casing 2.

Chamber 13 comprises an outlet passage 21 in turn comprising two portions 22, 23; portion 22 comprises a calibrated-section hole 24 and is formed in disk 20 at a distance from axis 3; and portion 23 is formed in a tubular body 25 coaxial with disk 20.

Appropriate locating systems (not shown) are preferably provided between disk 20 and body 25 to align portions 22, 23 when assembling injector 1.

Body 25 is gripped axially, in fluidtight manner and in a fixed position, against disk 20 by a ring nut 27 screwed to an inner surface 28 of casing 2, and comprises an axial through seat 29 defined by a cylindrical surface 30 through which portion 23 comes out.

Seat 29 is engaged by a slide shutter 32 defined by a mushroom pin comprising a cylindrical stem bounded by a cylindrical outer surface 33, which mates in substantially fluidtight manner with surface 30 with a sufficiently small calibrated diametrical clearance, e.g. of less than 4 micron, or with the interposition of sealing elements, such as rings made of bronze-filled PTFE or materials known by the trade names "Turcite" or "Turcon".

The cylindrical stem comprises an annular chamber 34 formed in surface 33, and terminates with a head 35 adjacent to chamber 34 and having a conical shoulder 36 which rests on a conical stop shoulder 37 defining an extension of surface 30.

Shutter 32 is slid axially by an actuating device 39 between a withdrawn closed position, in which passage 21 is closed by fluidtight mating of shoulders 36, 37 on one side, and of surfaces 30, 33 on the other, and a forward open position, in which passage 21 communicates with a discharge or recirculating conduit (not shown) to vary the pressure in control chamber 13 and so open and close the injection nozzle by axial translation of rod 7.

In the withdrawn position, fuel flows out radially into chamber 34, and exerts zero axial resultant thrust on shutter 32; and, in the forward position, fuel flows into the discharge or recirculating conduit via chamber 34, via a gap between shoulders 36, 37, and via a passage 38 formed in shutter 32.

Device 39 comprises a piezoelectric actuator 40 (shown partly) and a preloaded spring 42, located at opposite axial ends of shutter 32.

Actuator 40 rests directly on shutter 32, and, when subjected to voltage (in a manner not shown), deforms to exert axial thrust on shutter 32 in the opposite direction to that exerted by the preload of spring 42.

Spring 42 is interposed axially between shutter 32 and disk 20, and is housed partly in a cavity 43 formed axially inside head 35, and partly inside an axial recess 44 formed in disk 20 and also housing part of head 35.

As will be clear from the foregoing description, servo valve 8 satisfies the demand for employing an piezoelectric actuator, and at the same time, even with relatively little lift of the shutter, provides for relatively ample flow sections for the fuel flowing from passage 21 to the discharge or recirculating conduit via annular chamber 34, precisely by virtue of annular chamber 34 itself.

Passage 21 and the sliding movement of shutter 32 inside seat 29 provide for axially balancing the pressure forces on shutter 32 in the withdrawn closed position, and so enabling a roughly 30% reduction in the preload of spring 42, as compared with known solutions in which the shutter closes the outlet of chamber 13 axially or frontally, so that relatively straightforward, compact piezoelectric actuators may be used.

By virtue of the ample flow sections provided, even with relatively little lift or axial travel of shutter 32, shutter 32 may be activated directly by piezoelectric actuator 40, with no need for transmission and/or travel amplification systems in between.

Given the characteristics of body 25, shutter 32, and disk 20, spring 42 is relatively easy to assemble, and body 25 relatively easy to grip in place by means of ring nut 27.

Clearly, changes may be made to the control servo valve 8 as described and illustrated herein without, however, departing from the scope of the present invention.

In particular, chamber 34 and/or the form of passage 21 may differ from those illustrated by way of example, while still providing for zero axial resultant fuel pressure on shutter 32 in the closed position.

The invention claimed is:

1. A servo valve for controlling an internal combustion engine fuel injector; the servo valve being housed in a casing of said injector, and being characterized by comprising:

an actuator comprising a piezoelectric actuator;

a control chamber communicating with a fuel inlet and having a fuel outlet passage;

a tubular portion fixed with respect to said casing, and defining an inner cylindrical seat extending along a longitudinal axis; and a cylindrical shutter engaging said inner cylindrical seat in substantially fluidtight manner, and defining, together with said tubular portion, an annular chamber in which said outlet passage comes out; the shutter having a discharge passage adapted to be put in communication with said annular chamber and being slidable axially by said piezoelectric actuator from a closed position, in which it closes said annular chamber and is subjected to a zero axial resultant force by the fuel pressure, to an open position, opening a communication path between said outlet passage and said discharge passage, to close and open a nozzle of said injector.

2. A servo valve as claimed in claim 1, characterized in that said shutter rests axially and directly on said piezoelectric actuator.

3. A servo valve as claimed in claim 1, characterized in that said actuator also comprises a preloaded spring interposed axially between said shutter and an end wall axially bounding said control chamber.

4. A servo valve as claimed in claim 3, characterized in that said preloaded spring is housed partly inside an axial cavity in said shutter.

5. A servo valve as claimed in claim 1, characterized in that said annular chamber is formed in a cylindrical outer surface of said shutter.

6. A servo valve as claimed in claim 1, characterized in that said tubular portion and said shutter comprise respective conical shoulders located at the opposite axial end to said piezoelectric actuator, and which contact each other in fluidtight manner in said closed position.

7. A servo valve as claimed in claim 1, characterized in that said shutter fits inside said inner seat in said tubular portion with a calibrated clearance.

8. A servo valve as claimed in claim 1, characterized in that said inner seat is in said tubular portion with sealing members therebetween.

9. A servo valve for controlling an internal combustion engine fuel injector; the servo valve being housed in a casing of said injector, and being characterized by comprising:

an actuator comprising a piezoelectric actuator;

a control chamber communicating with a fuel inlet and having a fuel outlet passage;

a tubular portion fixed with respect to said casing, and defining an inner seat extending along a longitudinal axis; and a shutter engaging said inner seat in substantially fluidtight manner, and defining, together with said tubular portion, an annular chamber in which said outlet passage comes out; the shutter being slidable axially by said piezoelectric actuator from a closed position, in which it closes said annular chamber and is subjected to a zero axial resultant force by the fuel pressure, to an open position, opening said outlet passage to close and open a nozzle of said injector, characterized in that said actuator also comprises a preloaded spring interposed axially between said shutter and an end wall axially bounding said control chamber, and, characterized in that said tubular portion is defined by a tubular body gripped axially against said end wall by a ring nut screwed to said casing.

10. A servo valve as claimed in claim 9, wherein said control chamber is bounded axially on one side by a rod controlling a shutter pin for operating and closing said nozzle, and on the other side by an end disk located inside said casing coaxially with said tubular body, said outlet passage coming out from said control chamber and passing through said end disk.

11. A servo valve as claimed in claim 9, wherein said control chamber is bounded axially on one side by a rod controlling a shutter pin for operating and closing said nozzle, and on the other side by an end disk located inside said casing coaxially with said tubular body, said outlet passage coming out from said control chamber and passing through said end disk.

12. A servo valve for controlling an internal combustion engine fuel injector; the servo valve being housed in a casing of said injector, and comprising:

an actuator comprising a piezoelectric actuator;

a control chamber communicating with a fuel inlet permanently through an inlet passage and with a fuel outlet through an outlet passage comprising a calibrated section hole;

a single tubular body fixed with respect to said casing, and defining an inner seat extending along a longitudinal axis; and a shutter defined by a single pin body, engaging said inner seat in substantially fluidtight manner, and defining, together with said single tubular body, an annular chamber; the shutter being slidable axially by said piezoelectric actuator from a closed position, in which it closes said annular chamber and is subjected to a zero axial resultant force by the fuel pressure, to an open position opening said outlet passage, to close and open a nozzle of said injector; wherein said control chamber is bounded axially on one side by a rod controlling a shutter pin for opening and closing said nozzle, and on the otherside by an end disk located inside said casing coaxially with said single tubular body;

said outlet passage is distinct from said inlet passage, comes out from said control chamber, passes through said end disk, and flows into said annular chamber; and said single tubular body comprises:

a cylindrical surface, through which said outlet passage comes out, and a conical shoulder defining an extension of said cylindrical surface and a stop for said single pin body.

* * * * *